United States Patent [19]

Sahnas

[11] 4,285,888

[45] Aug. 25, 1981

[54] CARBURETOR FOR INTERNAL COMBUSTION ENGINES

[76] Inventor: George Sahnas, 4126 N. Austin Ave., Chicago, Ill. 60634

[21] Appl. No.: 105,605

[22] Filed: Dec. 20, 1979

[51] Int. Cl.[3] ..... F02M 7/14

[52] U.S. Cl. ..... 261/59; 261/64 A; 261/69 R; 261/DIG. 39

[58] Field of Search ..... 261/64 A, 59, 69 R, 261/51, DIG. 39

[56] References Cited

U.S. PATENT DOCUMENTS

| | | | |
|---|---|---|---|
| 1,559,756 | 11/1925 | Kemp | 261/64 A |
| 1,612,352 | 12/1926 | Boehner | 261/51 |
| 1,643,479 | 9/1927 | Williams, Jr. | 261/69 R |
| 1,998,784 | 4/1935 | Mock | 261/DIG. 39 |
| 2,009,992 | 8/1935 | Beals | 261/64 A |
| 2,254,634 | 9/1941 | Tomsic | 261/51 |
| 2,828,115 | 3/1958 | Register | 261/51 |
| 3,248,097 | 4/1966 | De Rugeris | 261/51 |
| 3,510,112 | 5/1970 | Winquist et al. | 261/DIG. 39 |
| 3,667,740 | 6/1972 | Mortstedt | 261/69 R |

*Primary Examiner*—Tim R. Miles

*Attorney, Agent, or Firm*—Emrich, Root, Lee, Brown & Hill

[57] ABSTRACT

A carburetor for use with internal combustion engines, wherein a jet spray of fuel is directed into the intake manifold of the engine, and the amount of fuel so sprayed under pressure is controlled by the movement of a diaphragm actuated in response to the volume of air entering the carburetor housing, so that the air-fuel mixture always will be in such proportions that all of the fuel will be burned, thereby substantially eliminating the exhaust of unused fuel to the atmosphere and the resulting air pollution, as well as increasing the engine's operating efficiency, and improving the economy.

6 Claims, 6 Drawing Figures

3
4
5,6
1
2
6
7
8
9
10
16
18
19
20
21
22
23
24
26
28
29
30
31
32
33
34
35
36
37
38
39
41
42
43
44
45
47
48
49
50
51
52
53
54
55

CARBURETOR FOR INTERNAL COMBUSTION ENGINES

BACKGROUND OF THE INVENTION

With the advent of the anti-pollution laws and requirements for automobile manufacturers to provide emission devices on internal combustion engines which will reduce air pollution, many ideas and suggestions have been made to accomplish this purpose, and some are in use today. Some of these emission control devices are more efficient than others, some are quite expensive and complicated and frequently become a source of trouble in operating the automobile.

The present invention is designed to overcome the disadvantages of those of such emission control devices now on the market by providing a carburetor which is economical to make and operate, is uncomplicated and relatively easy to maintain.

BRIEF SUMMARY OF THE INVENTION

The invention relates in general to a carburetor for internal combustion engines, and more particularly to a carburetor so constructed as to substantially reduce or eliminate air pollution by insuring that substantially all of the fuel is burned, leaving no exhaust gases to pollute the atmosphere.

Briefly described, fuel enters the intake manifold from the fuel pump through a small annular passageway and around a valve head which creates a very fine fuel spray of a conical shape. The spray is so fine it may be referred to as a "micrometer jet" spray. The amount of fuel is controlled by the volume of air entering the housing of the carburetor, so that increased air supply will result in increased fuel supply, thereby maintaining proper air-fuel mixture for efficient operation.

A butterfly valve is provided in the carburetor housing adjacent an air filter where air enters the housing. In the engine-idle position of the butterfly valve it will allow a minimum amount of air to pass, and it may be rotated manually or by an accelerator pedal to positions where increased amounts of air enter, and when it is fully opened the engine will be at full throttle.

A diaphragm chamber is mounted on the carburetor housing at one side thereof and is in communication with the interior of the housing through openings therein. On the opposite side of the diaphragm the chamber is in communication with the atmosphere, so that one side of the diaphragm will be subject to atmospheric pressure. Air passing through the butterfly valve and past the openings which communicate with the diaphragm chamber will create a suction, so that the pressure therein will be less than atmospheric, and the diaphragm will normally be positioned in one extreme position thereof which may be referred to as the engine-idle position. As the butterfly valve is opened more, and an increased volume of air enters the carburetor housing, the diaphragm will be moved toward the opposite position thereof toward the engine full-throttle position, and as it moves it carries with it a control rod which actuates a control lever operable to increase the fuel supply.

In view of the foregoing it is a primary object of the present invention to provide an improved anti-pollution carburetor for internal combustion engines which is simple in construction and economical to operate.

Another object is to provide such a carburetor wherein the accelerator control operates to control the amount of air admitted from the atmosphere into the carburetor housing, and which air controls the amount of fuel admitted to the intake manifold, thereby to maintain the most efficient air-fuel mixture.

A further and more specific object of the invention is to provide a novel arrangement to create an extremely fine conical-shaped jet spray which is delivered into the intake manifold.

Other objects and purposes of the invention will become more apparent as the description proceeds, reference being had to the accompanying drawings.

DETAILED DESCRIPTION

Figure 1:
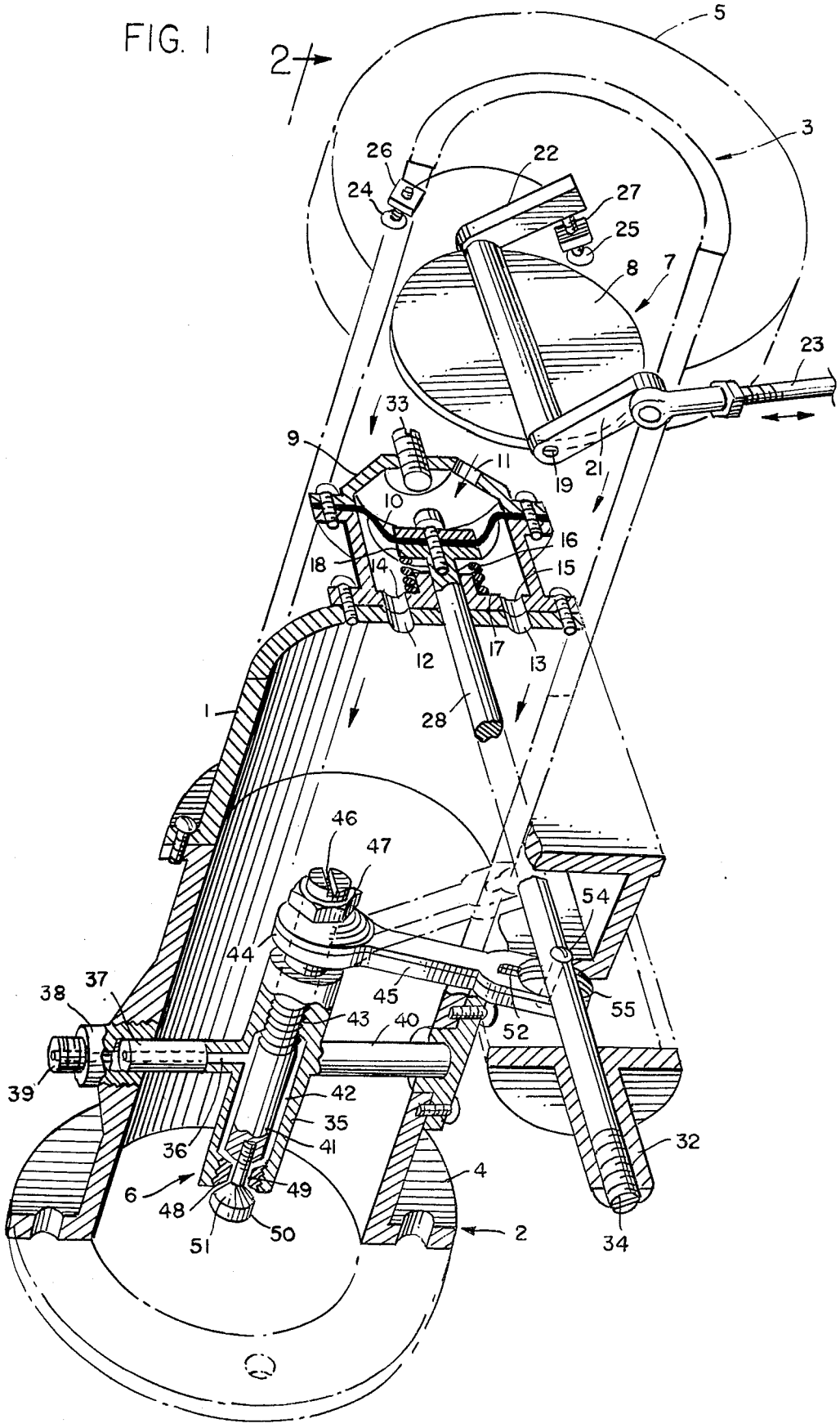
FIG. 1 is a perspective view partly in vertical section and partly in phantom illustrating the carburetor of the present invention.

Referring now more particularly to the drawings and especially to FIG. 1, the carburetor is a single barrel, and the housing is indicated by the numeral 1. As may be noted in FIG. 1, the housing is preferably circular in cross-section and is elongated so as to provide a first end generally indicated by the numeral 2, and a second end generally indicated by the numeral 3. Said first end is provided with a flange 4 thereon which is adapted to be connected to the intake manifold of the engine. The second end 3 of the housing has an air filter 5, shown in phantom, associated therewith, and air is admitted into the carburetor housing 1 therethrough.

A fuel valve, generally indicated by the numeral 6, is located within the carburetor housing and adjacent the first end 2 thereof. As will be explained more fully hereinafter this fuel valve is connected to the fuel pump of the engine, which delivers fuel from the fuel filter under about 1 or 2 atmospheres of pressure which is always constant, and is so constructed as to spray a conically-shaped jet stream of fuel into the intake manifold.

The other end 3 of the carburetor housing is provided with a butterfly valve generally indicated by the numeral 7. The housing of the carburetor is generally circular, and the butterfly valve 7 is likewise circular and consists of a circular disc 8 rotatably mounted between a substantially closed position, which is the engine-idle position, and an open position, which may be referred to generally as the engine full-throttle position.

Figure 6:
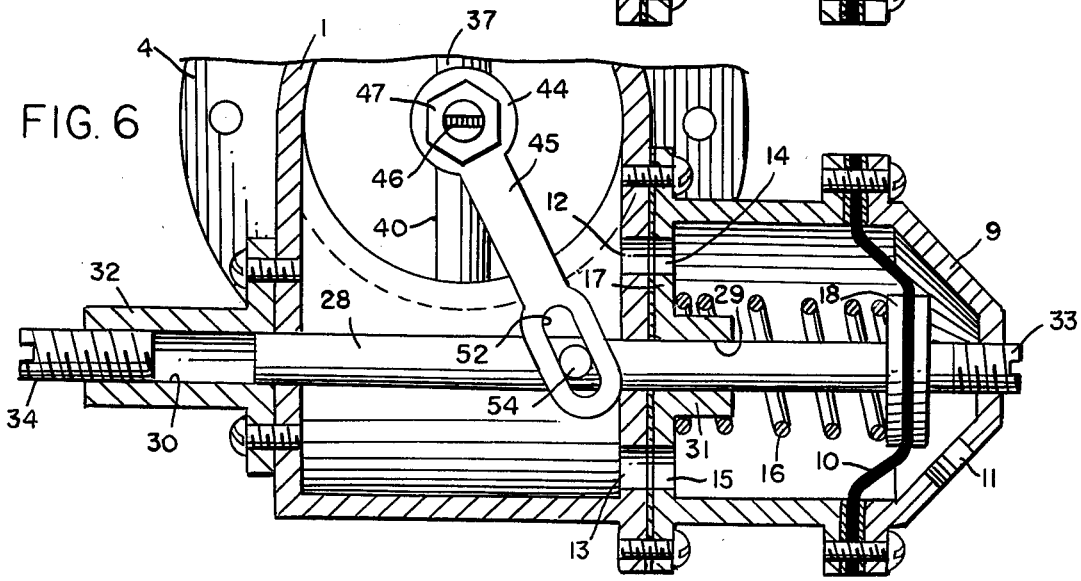
FIG. 6 is a view similar to FIG. 5 but showing the fuel valve control in engine full-throttle position.

Intermediate the ends 2 and 3 of the carburetor housing there is provided a diaphragm chamber 9 which houses the diaphragm 10 therein. Again, as will be seen more clearly hereinafter, the diaphragm 10 has two extreme positions, one of which is shown in FIGS. 1 and 5, and which may be referred to as the engine-idle position, and the other of which is shown in FIG. 6, which may be referred to as the engine full-throttle position.

Figure 5:
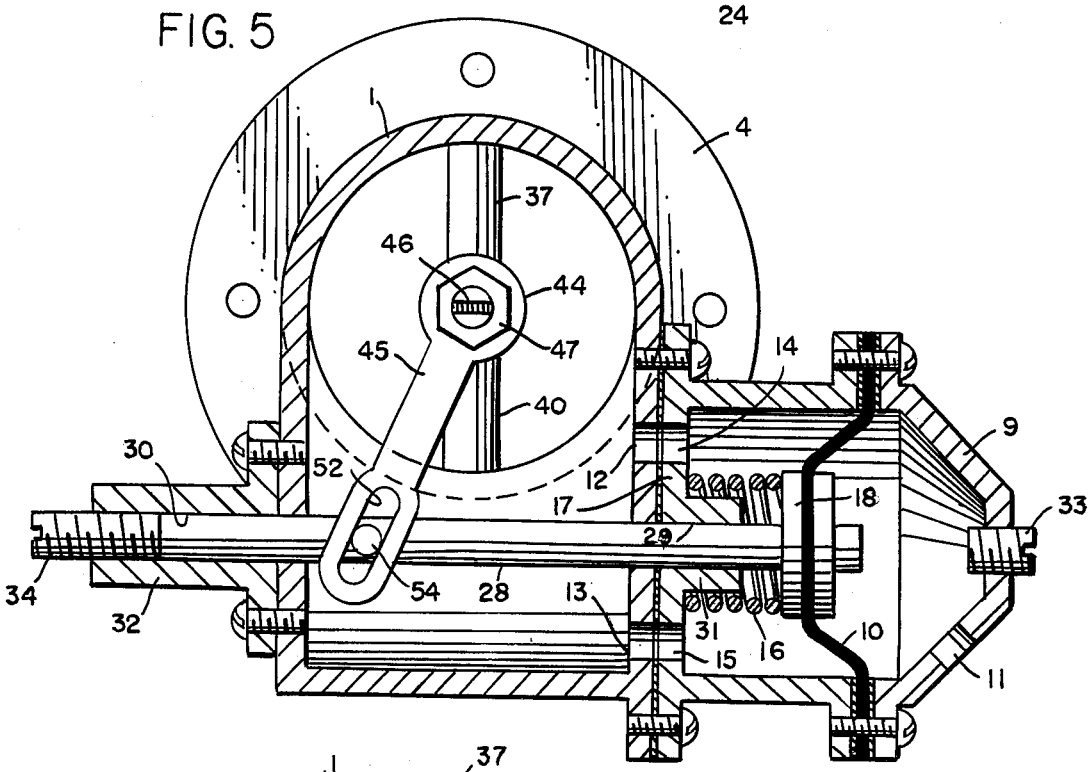
FIG. 5 is a transverse sectional view taken substantially along the plane of line 5—5 of FIG. 2 showing the fuel valve control in the engine-idle position thereof.

The chamber 9 on one side of the diaphragm 10 has an opening 11 therethrough to the atmosphere so that under normal atmospheric pressure the diaphragm is in the engine-idle position as shown in FIGS. 1 and 5. The opposite side of the diaphragm is under a pressure which is less than atmospheric. The reason for this is that there is a plurality of openings in the wall of the housing 1 where the chamber 9 is mounted in communication with a like plurality of openings in the chamber itself. For example, openings 12 and 13 in the housing are in alignment with openings 14 and 15 of the chamber. The air passing by the butterfly valve in the carburetor housing tends to create a vacuum in the chamber on one side of the diaphragm as it passes the openings 12 and 13.

There is also a relatively light coiled compression spring 16 having one end thereof bearing against a shoulder 17 on the wall of the chamber, and the other end thereof bears against the flange 18 on one side of the diaphragm, and which is formed on one end of a control rod. The strength of the spring 16 is not great enough to force the diaphragm and move it against the atmospheric pressure on the opposite side thereof.

The arrangement is such that, with the butterfly valve 7 in the engine-idle position, as shown in FIGS. 1 and 5, the diaphragm 10 will likewise be in its engine-idle position and the fuel valve 6 will be in an appropriate position to allow just enough fuel to enter the intake manifold to run the engine at idle speed.

As the butterfly valve is rotated to a more open position a greater volume of air will be admitted into the main housing of the carburetor, which will move slower past the openings into the diaphragm chamber, thereby creating less vacuum and allowing spring 16 to move the diaphragm toward its engine full-throttle position, and when this occurs such movement of the diaphragm will control the fuel valve in such a way as to permit additional fuel to enter the intake manifold thereby increasing the speed of the engine.

Figures 2, 3:
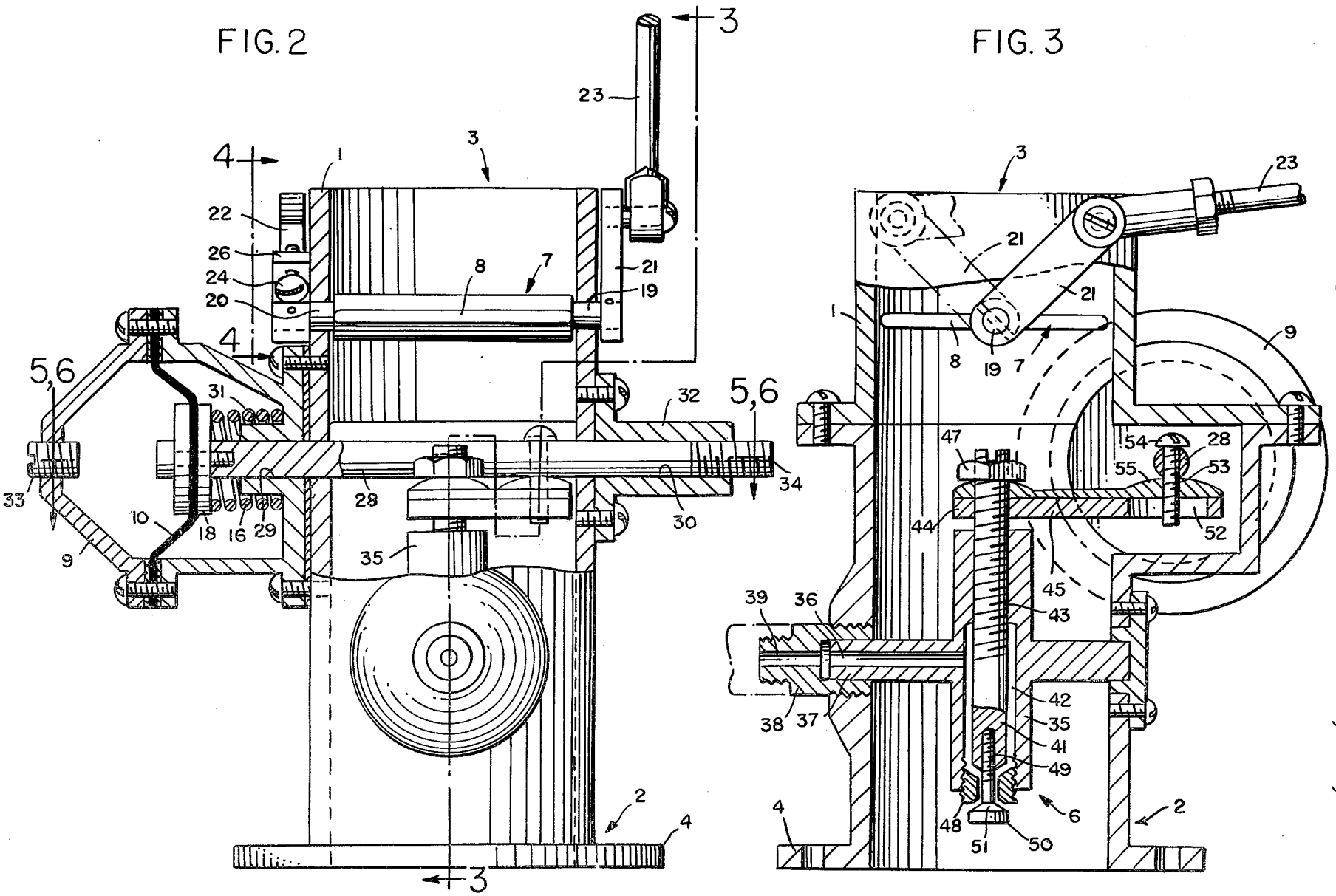
FIG. 2 is a vertical elevational view partly in section of the carburetor shown in FIG. 1 and taken substantially along the plane of line 2—2 of FIG. 1.
FIG. 3 is a vertical sectional view taken substantially along the plane of line 3—3 of FIG. 2.
Figure 4:
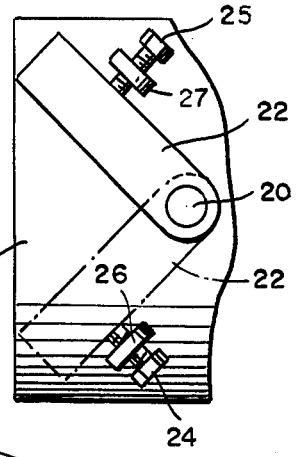
FIG. 4 is a fragmentary elevational view taken substantially along the plane of line 4—4 of FIG. 2 showing the adjustments for controlling the idle and full-throttle positions of the butterfly valve.

The disc 8 is suitably mounted in the wall of the carburetor main housing for pivotal movement. It is provided on opposite sides thereof with trunnions 19 and 20 which extend through the carburetor housing and have mounted thereon the arms 21 and 22 respectively. One of the arms 21 may have connected to the outer end thereof a control rod 23 which may be in turn connected to a suitable accelerator pedal for longitudinal reciprocation. As may be seen from FIGS. 1 and 3, the butterfly valve is in its normal engine-idle position, and when the rod 23 is moved toward the left as viewed in these Figures, such movement will cause the levers 21 and 22 to rotate the trunnions 19 and 20, thereby also rotating the disc 8 of the butterfly valve. In FIG. 3 the full line position of the levers 21 and 22 will position the disc 8 of the butterfly valve in the engine-idle position thereof. Movement of the rod 23 will rotate the levers to the position thereof shown in the dot-dash lines of FIG. 3 which thereupon will be the engine full-throttle position, wherein the maximum amount of air will be admitted to the carburetor housing.

The engine-idle and the engine full-throttle positions of the air valve may be adjusted as desired by the use of adjustable stop means. Such stop means may preferably comprise adjusting screws 24 and 25 which threadedly engage internally threaded nuts or other suitable means 26 and 27 mounted on the outside of the wall of the carburetor housing. By adjusting the screws 24 and 25 inwardly or outwardly the amount of air admitted to the housing through the air valve means may be regulated both for the engine-idle and for the engine full-throttle positions thereof.

As described above, FIGS. 1, 2, 3 and 5 illustrate the engine idle positions of the various parts, including the butterfly valve, the diaphragm which controls the fuel valve, and the fuel valve itself. It has also been explained that when the butterfly valve is opened to cause the flow of a greater volume of air past the openings into the diaphragm chamber, the air will move at a slower rate of speed thereby creating less suction within the diaphragm chamber on that side of the diaphragm which contains the spring 16, and this allows the spring to exert a force against the diaphragm to move it toward the engine full-throttle position.

As also mentioned above, the inner end of spring 16 bears against the flange 18 on the end of the control rod 28 which extends transversely through the carburetor housing and the walls thereof and is guided for longitudinal reciprocation in the bores 29 and 30 of the cylindrical guide members 31 and 32 respectively.

The length of travel of the control rod 28 in each direction is regulated by the adjusting screws 33 and 34. The adjusting screw 33 threadedly engages an opening in the diaphragm chamber 9, as may be seen in FIGS. 1, 2, 5 and 6. The other adjusting screw 34 threadedly engages the bore 30 in the guide member 32 at the opposite side of the carburetor housing, as may also be seen in FIGS. 1, 2, 5 and 6. In FIGS. 1, 2 and 5, the diaphragm 10 is in the engine-idle position where one end of the control rod 28 is shown as abutting against the inner end of the adjusting screw 34. When the diaphragm 10 is caused to move to the engine full-throttle position thereof as above described, the control rod 28 will move with it toward the adjusting screw 33, and when it reaches the engine full-throttle position as shown in FIG. 6, the end of control rod 28 will be in contact with the inner end of the adjusting screw 33.

As may be seen particularly in FIGS. 1 and 3, the fuel valve 6 includes a tubular body member 35 positioned within the carburetor housing which receives fuel under pressure from the fuel pump (not shown) through the passageway 36 in the tubular support member 37. The support member 37 is received within the bore of a connecting member 38 which threadedly engages an opening in the wall of the carburetor housing. The threaded tubular member 39 forms a connection with the fuel pump, so that fuel from the pump under pressure is fed through the connection 39 and the passage 36 in the support member 37. The inner end of the passage 36 communicates with the hollow interior of the tubular body member 35 and may be seen in both FIGS. 1 and 3.

The opposite side of the body member 35 is provided with a support arm 40 which extends into a recess at the opposite side of the housing so that the tubular body member 35 is rigidly supported within the carburetor housing.

A valve stem 41 is positioned within the tubular body member 35 and is spaced from the inner walls thereof thereby to provide the annular passageway 42 between the valve stem 41 and the inner surface of the wall within the body member 35. The upper end of the valve stem 41 is threaded as indicated at 43 and threadedly engages the internally threaded portion of the upper end of the bore within the tubular body member 35. This may be more clearly seen by viewing FIG. 3. The valve stem 41 extends upwardly through the upper end of the tubular body member 35 and threadedly engages one end 44 of a lever arm 45 which extends away therefrom toward the control rod 28.

The upper end of the valve stem 41 is slotted, as at 46, to receive the end of a screwdriver for adjusting purposes. Thus, by moving the valve stem up or down by rotating it with a screwdriver the longitudinal position of the valve stem within the body 35 may be adjusted and is one of the means whereby the amount of fuel entering the intake manifold may be regulated. A lock nut 47 is utilized for the purpose of locking the valve stem 41 in its adjusted position.

The lower end of the tubular body member 35 is provided with a removable valve seat 48 which has an opening therethrough to receive the stem 49 of the valve head 50. The stem 49 is threaded and engages a threaded opening in the lower end of the valve stem 41. The valve seat 48 has an annular inclined surface which is complementary with the conical surface 51 of the valve head 50, and when the appropriate spacing is provided between the valve seat 48 and the valve head 50, the fuel fed to the fuel valve from the fuel pump will be under constant pressure and will pass around the annular space 42 and will be forced outwardly through the space between the valve seat 48 and the valve head 50 resulting in a conically-shaped jet stream of fuel being delivered into the intake manifold. This fuel will, of course, be mixed with the air entering the carburetor housing past the butterfly valve, and the appropriate adjustment for the fuel valve as well as for the butterfly valve, will result in a proper mixture of fuel and air so that substantially all of the fuel will be burned and none of it will be left to pollute the atmosphere.

The outer end of the lever arm 45 is suitably connected in any appropriate manner with the control rod 28. In the particular embodiment shown herein, the outer end of the arm 45 has an elongated slot 52 therein and receives the shank 53 of a screw 54 which extends downwardly through, and threadedly engages, the member 55. The screw 54 passes downwardly through the control rod 28 and through the member 55 and into the slot 52, so that, when the rod 28 is moved longitudinally, it will carry with it the lever arm 45 and move it in an arcuate direction, whereupon the shank 53 of the screw will traverse the slot 52.

In the position of the various parts shown in FIG. 1, the diaphragm will be in its engine-idle position, the control rod 28 will be in the position where the end thereof will abutt against the adjusting screw 34, the lever arm 45 will be in its engine-idle position so that the spacing between the valve seat 48 and the valve head 50 will be such that the least amount of fuel is being sprayed into the intake manifold. Likewise, the butterfly valve will be in its closed position as shown in FIG. 1 so that the least amount of air will also enter the carburetor housing. Thus, there will be the condition where only enough air and enough fuel will be mixed together and enter the intake manifold for the idling of the engine.

As the control rod 23 from the accelerator is moved to open the butterfly valve and allow more air to enter the carburetor housing, and thus create a lesser vacuum in the diaphragm chamber 9, the spring 16 will urge the diaphragm 10 and the control rod 28 connected therewith, toward the adjusting screw 33. When this occurs, the control rod 28 will carry with it the lever arm 45, thereby rotating the valve stem 41 connected thereto and, due to its threaded engagement with the internal threads of the tubular housing 35, will move the valve stem 41 and the valve head 50 downwardly so that more fuel will be expelled therefrom in a conical jet stream into the intake manifold.

Thus, the greater the volume of air which enters the carburetor housing past the air valve, the greater will be the amount of fuel which enters and mixes with the air to be delivered into the intake manifold.

In this arrangement, assuming normal operation and the carburetor properly adjusted, there will always be the proper mixture of air and fuel so that all of the fuel will be burned and none will remain to be exhausted into the atmosphere.

It will be understood that the present disclosure is of the preferred embodiment of the invention and has been made only by way of example. Numerous changes in the details of construction and arrangement of the parts may be resorted to without departing from the spirit and the scope of the invention as hereinafter claimed.

I claim:

1. A carburetor for internal combustion engines having a fuel pump and an intake manifold comprising (a) an elongate main housing having
  (1) a first end adapted to be connected to the intake manifold of the engine, and
  (2) a second end adapted to be connected to a source of air, (b) fuel valve means in said housing adjacent said first end thereof including
  (3) a tubular body member axially disposed within said housing and containing a longitudinal bore adapted to receive fuel under pressure from the fuel pump,
  (4) a valve seat on the end of said body member adjacent to and facing said first end of the housing,
  (5) a valve stem within the bore of said body member having a peripheral portion spaced from the surrounding inner wall of the bore to provide an annular passageway around the valve stem which connects to the fuel pump,
  (6) a valve member mounted on said valve stem providing an annular space between the valve member and the valve seat through which fuel passes to the intake manifold from said annular passageway, and
  (7) the valve stem being threadedly connected with the body member whereby rotation of the valve stem with respect to the body member moves the valve member axially of the body member to change the spacing of the valve member from the valve seat, (c) air valve means in said housing adjacent the second end thereof movable between an engine idle position for minimum air passage therethrough and an engine full-throttle position for maximum air passage therethrough, (d) means for controlling the fuel valve means including
  (8) a diaphragm movable between engine idle and engine full-throttle positions, having one side communicating with atmosphere and its opposed side communicating with the interior of the housing between the air valve means and the fuel valve means so as to be movable between said positions in response to a change of air volume admitted by the air valve means into the housing, and (9) means operably connecting said diaphragm with said valve stem whereby movement of said diaphragm rotates said valve stem on its threaded connection to the fuel valve body member in response to a change in volume of air flow through the housing such that the air supply to the intake manifold of the engine increases as the fuel supply thereto is increased, and (e) means to move said air valve means between the engine idle and the engine full-throttle positions thereof.

2. A carburetor as defined in claim 1, wherein said air valve means comprises a butterfly valve.

3. A carburetor as defined in claim 1, including a chamber in which said diaphragm is mounted and which is in communication with the interior of said main housing, means to admit air into said chamber at atmospheric pressure on the side of said diaphragm opposite to that side of the chamber which is in communication with said main housing, thereby normally urging said diaphragm to the engine idle position thereof.

4. A carburetor as claimed in claim 1, wherein the valve seat member has an annular inclined surface and the valve member has a conical surface complementing the valve seat surface, the valve member being adjustable relative to the valve stem on which it is mounted to change the spacing of the valve member from the valve seat.

5. A carburetor as defined in claim 1, wherein said means operably connecting said diaphragm with said fuel valve means comprises a lever arm connected at one end thereof to said valve stem, an elongated rod connected at one end thereof to said diaphragm and movable therewith, and means connecting said rod with said lever arm, whereby movement of said diaphragm will move said rod and lever arm connected therewith to operate said valve stem and control said fuel valve means.

6. A carburetor as claimed in claim 5 having adjustable stop means which limit the travel length of the rod and thereby the axial movement of the valve member of the body member and the spacing of the valve member from the valve seat.

* * * * *